United States Patent [19]

Yamazaki et al.

[11] 4,358,837

[45] Nov. 9, 1982

[54] TIME CORRECTING METHOD

[75] Inventors: Suguru Yamazaki; Tadamori Saito, both of Suwa, Japan

[73] Assignee: Kabushiki Kaisha Suwa Seikosha, Tokyo, Japan

[21] Appl. No.: 20,153

[22] Filed: Mar. 13, 1979

[30] Foreign Application Priority Data

Mar. 13, 1978 [JP] Japan ..... 53/28518

[51] Int. Cl.[3] ..... G04C 17/00; G04C 9/00; G04B 29/00

[52] U.S. Cl. ..... 368/69; 368/187; 368/190; 368/321

[58] Field of Search ..... 58/85.5, 23 R; 368/155, 368/184, 185, 186, 187, 188, 69–70, 190, 308, 319–321

[56] References Cited

U.S. PATENT DOCUMENTS 4,091,612 5/1978 Meisner et al. ..... 58/85.5
4,196,584 4/1980 Oda ..... 368/187

*Primary Examiner*—Vit W. Miska
*Attorney, Agent, or Firm*—Blum, Kaplan, Friedman, Silberman and Beran

[57] ABSTRACT

In an electronic timepiece the digital display of time functions is corrected by the manipulation of a multi-contact rotary switch. Rotation of the switch in one direction corrects one displayed function, e.g., hours and minutes, and rotation of the switch in the other direction corrects another displayed function, e.g., day and date. The rate of display correction is responsive to the rate of switch rotation. Rotational direction is electronically determined by detecting which contact in the rotary switch is the first to close. Rate of switch rotation is determined by measuring the time required in cyclic actuation of the rotary switch contacts.

20 Claims, 6 Drawing Figures

TIME CORRECTING METHOD

BACKGROUND OF THE INVENTION

This invention relates generally to an electronic timepiece which provides for the display of many functions and more particularly to an electronic timepiece where the display of functions is corrected by rotating an external member, the direction of rotation of the external member determining which display function is to be corrected and the rate of rotation of the external member determining the rate of correction of the function. In the conventional digital display of electronic timepieces of the prior art, there is generally a need for two switches for time correction, one for selecting the digit to be corrected among the functions, digitally displayed, i.e., second, minute, hour, day, date, etc. Another switch is used for advancing the selected digit of the function to be corrected. For a watch wearer accustomed to a mechanical timepiece, this double switch procedure creates a disagreeable condition and also puts a limitation on the appearance design and size of the wristwatch.

What is needed is an electronic timepiece having a digital display wherein the display function is corrected by the rotation of an external member similar to the crown of a mechanical wristwatch. It is also desirable in electronic timepieces providing for the display of many functions, that a plurality of displays be correctible by means of the same external member. The rate of correction should be variable so that excessive time is not required to make large corrections.

SUMMARY OF THE INVENTION

Generally speaking, in accordance with the invention, an electronic timepiece especially suited for the correction of the digitally displayed functions is provided. In the electronic timepiece of this invention the display of time functions is corrected by the manipulation of a multi-contact rotary switch. The rate of display correction is responsive to the rate of switch rotation. Rotational direction is electronically determined by detecting which contact in the rotary switch is the first to close. Rate of switch rotation is determined by measuring the time required in cyclic actuation of the rotary switch contacts. This invention eliminates the above mentioned defects in the prior art timepieces and offers a time correcting device using only one rotary switch, which is similar in appearance and operation to the crown of a conventional mechanical timepiece. More particularly, the time correcting device according to this invention is characterized in that the time correction is performed by detecting the direction of rotation and rotational speed of an externally actuated rotary switch comprising a plurality of mechanical contacts in combination.

Accordingly, it is an object of this invention to provide an electronic timepiece wherein a displayed time function is corrected by the external manipulation of a single member.

Another object of this invention is to provide an improved electronic timepiece where the rate of correction of a displayed function is determined by the rate of actuation of an external member.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
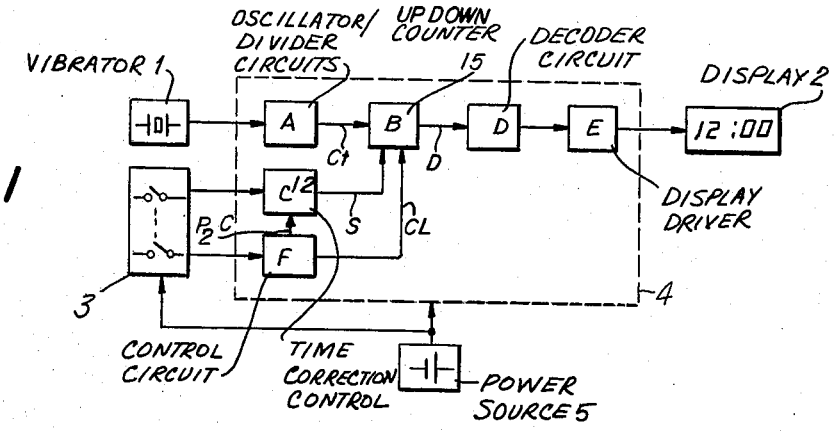
FIG. 1 is a functional block diagram showing a fundamental construction for a digital display electronic timepiece.
Figure 2:
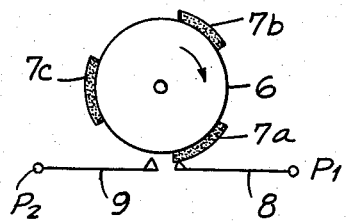
FIG. 2 is a simplified drawing of a rotary switch suited for time correction in the electronic timepiece of the invention.

The fundamental construction of a digital display electronic timepiece is shown in FIG. 1. The timepiece comprises a vibrator 1 which is a time standard, a display portion 2 for displaying the time, a plurality of switches 3, an integrated circuit 4, and a power source 5. The integrated circuit 4 is provided with an oscillating and dividing circuit A, a counter circuit B, a time correction control circuit C, a decoder D, a display driving circuit E and a control circuit F for various additional functions. FIG. 2 shows an exemplary switch of simple construction which generates a signal capable of detecting direction of rotation. The rotational body 6 is provided on its surface with conductors *7a*, *7b* and *7c* having a positive or negative of voltage of fixed magnitude from a power source (not shown) applied thereto. Conductors 8, 9 are fixed on an object (not shown) other than the rotational body 6. When the rotational body 6 rotates clockwise, the conductor 8 is contacted first by a conductor on the surface on the rotational body 6, and when there is counterwise rotation of the rotational body 6, the conductor 9 is contacted first by a conductor on the rotational body 6. So, when a positive voltage level is directly applied to the conductors *7a* to *7c* from the power source, and a negative voltage is directly applied to the conductors 8, 9 via high value resistors in the integrated circuit, a signal as shown in FIG. 3(*a*) is generated at terminals $P_1$ and $P_2$ (FIG. 2) when the rotary switch rotates clockwise and a signal as shown in FIG. 3(*b*) is generated at terminals $P_1$ and $P_2$ when the rotary switch rotates counterclockwise.

In an integrated circuit, the direction of the rotary switch rotation is detected by judging which signal, that is, signal $P_1$ or $P_2$, rises or falls first. Also the rotational speed of the rotational body 6 is detected by measuring the time period, for example $\tau_1$, $\tau_2$, $\tau_3$, etc., as shown in FIG. 3, or by counting the number of times the signal rises or falls in a fixed time period.

Two types of data are obtained from such a rotary switch, namely the direction of rotation and the rotating speed of the rotational body 6, whereby various time correcting methods are devised. For example, in one method clockwise rotation may advance the time display and counterclockwise rotation may turn back the time display. In each concept, the correction rate is controlled in response to the rotational speed of the switch. The number and position of the mechanical contacts provided on the rotary switch body 6 are not limited to the embodiment shown in FIG. 2. In other designs it is possible to combine other functions by using contacts which conduct when the rotary switch is pushed in, and other contacts which conduct when the switch is pulled out.

Figure 3A:
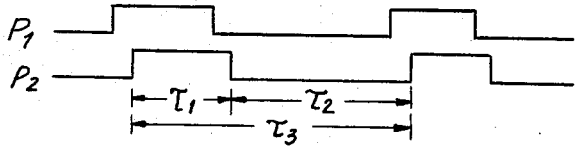
FIG. 3(*a*) is time chart of signals obtained by the clockwise rotation of the rotary switch of FIG. 2, and FIG. 3(*b*) is a time chart of signals obtained by the counterclockwise rotation of the switch of FIG. 2.
Figure 3B:
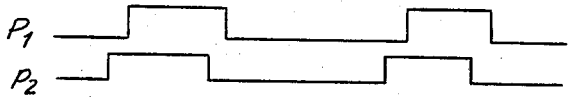
Figure 4:
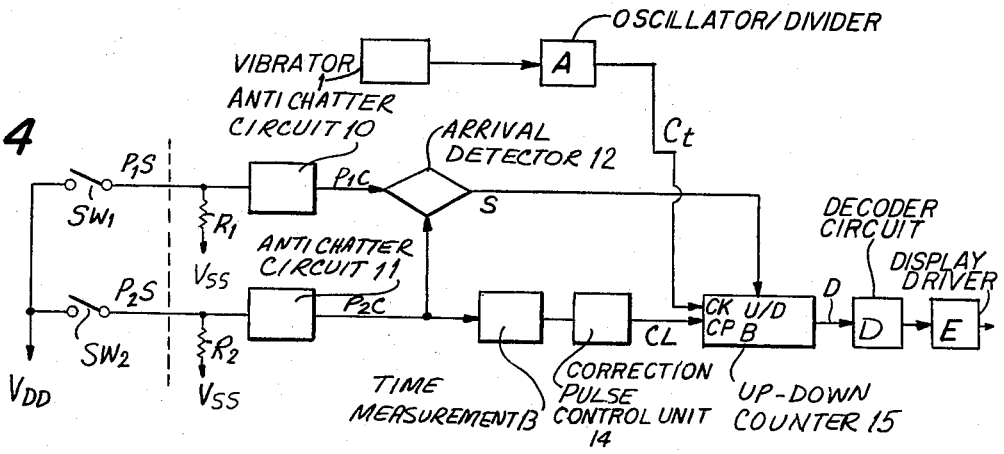
FIG. 4 is a functional block diagram of an electronic timepiece including the time correction features according to this invention.

In the time correction control circuit in accordance with the invention, preferably formed of an integrated circuit construction, such signals as shown in FIG. 3 may be obtained, the time is advanced or delayed in response to the direction of rotation of the rotary switch, and the correcting speed is controlled in response to the rotational speed of the switch. FIG. 4 is a block diagram of an embodiment of such circuitry. $SW_1$ and $SW_2$ are two mechanical contacts in the rotary switch. When the contacts are closed, the signals $P_1s$ and $P_2s$ are at the level of the supply voltage $V_{DD}$. When the switches are open, the signals $P_1s$ and $P_2s$ are at the supply voltage level $V_{SS}$ opposite to the level $V_{DD}$. High value resistors $R_1$ and $R_2$ between $V_{SS}$ and switches $SW_1$ and $SW_2$ respectively prevent floating of the signals $P_1s$ and $P_2s$. Anti-chatter circuits 10, 11 prevent undesired effects from chattering caused at the moment when the mechanical contacts are open or shut. If level matching is necessary between the signals $P_1s$ and $P_2s$ and the signal in the integrated circuit, the anti-chatter circuits can include a level shifter. Two output signals $P_1c$ and $P_2c$ of the anti-chatter circuits are evaluated to determine which signal is the first to arrive by the first arrival detector circuit 12. The output signal S from the first arrival detector circuit 12 becomes either a high level for low level signal depending on the sequence of arrival of signal $P_1c$ and $P_2c$. The time measuring circuit 13 measures a time period, for example, $\tau_1$, $\tau_2$, or $\tau_3$ shown in FIG. 3(*a*). The correction pulse control unit 14 is used for time correction. Therein, for one pulse of the signal $P_2c$ a number of time correction pulses $C_L$ are passed through to the up-down counter 15 during the measured period of time $\tau$. The pulses from the pulse control unit 14 are input to the CP terminal of the up-down counter 15. The up-down counter 15 counts up or down depending on the voltage level of the signal S, which is applied to the U/D input terminal of the up-down counter 15, and corresponds to the function B in FIG. 1. $C_t$ is a carrying or clock signal generated in the dividing circuit of function A in FIG. 1, and input to the clock input terminal CK of the up-down counter 15 D is an output signal from the up-down counter 15 which is fed to the decoder shown as function D in FIG. 1.

In an electronic timepiece displaying the hour, minute and second, such correction by means of the up-down counter is efficiently applied to the digit at the minute digit level, that is, the minutes and the hours are both corrected by feeding impulses which advance the minute digit. It is not practical to correct the hour digit by successively correcting from the second digit to the minute digit to the hour digit, because an inconveniently large number of revolutions of the rotary switch will be needed to accomplish such an adjustment, especially if the correction is of substantial magnitude.

Figure 5:
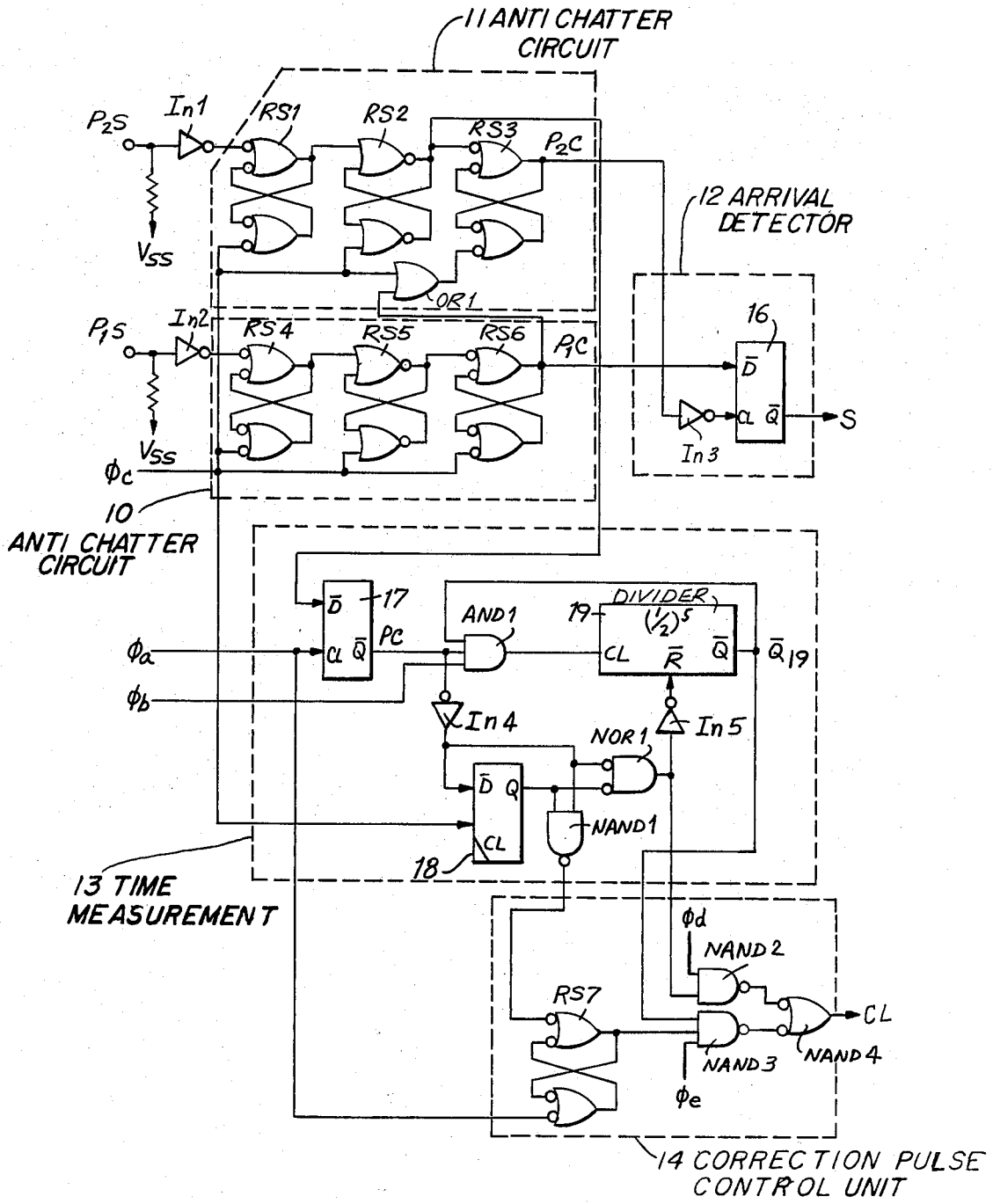
FIG. 5 is a circuit drawing for controlling the time correction in the timepiece of FIG. 4.

An example of an actual circuit based on the above described block diagram (FIG. 4) is illustrated in FIG. 5. The following is a brief explanation of the construction and operation of the circuit of FIG. 5. The two input signals $P_1s$ and $P_2s$ are connected to the gates of the inverters $In_1$ and $In_2$ respectively. The outputs of the inverters $In_1$ and $In_2$ are connected to the set side inputs of RS type flip-flops $RS_1$ and $RS_4$ respectively made up of NAND gates. The outputs $RS_1$ and $RS_4$ are connected to the set input of RS type flip-flops $RS_2$ and $RS_5$ respectively made up of NOR gates, and the outputs thereof are connected to the set inputs of RS type flip-flops $RS_3$ and $RS_6$ respectively made up of NAND gates. To the reset side inputs of $RS_1$, $RS_2$, $RS_4$, $RS_5$, and $RS_6$, a clock signal $\phi_c$ is applied. To the reset side input of $RS_3$ is connected the output from the OR gate OR 1 wherein the clock signal $\phi_c$ and the output $P_1c$ from $RS_6$ are applied. The signal $P_1c$ is also connected to the data input of delay flip-flop 16 having a delay of one bit. The set output $P_2c$ of $RS_3$ is inverted in the inverter $In_3$ and the output thereof is connected to the clock input of the flip-flop 16. The set output of $RS_2$ is connected also to the data input of the delay flip-flop 17 providing a delay of one bit. To the clock input of the flip-flop 17 is connected the clock signal $\phi_a$, and the output from flip-flop 17 feeds to AND gate 1 and to the gate of the inverter $In_4$. The AND gate 1 has three inputs, namely, the output Pc of the flip-flop 17, the clock signal $\phi b$ and the output $\overline{Q}_{19}$ from the divider 19 wherein five one/two dividers are connected in series to produce a one/sixty-four division. The output of the AND gate 1 is connected to the clock input of the divider 19. The output of the inverter $In_4$ is connected to the data input of the delay flip-flop 18 having a delay of one-half bit. The output of inverter $In_4$ is also connected to an input of NAND gate 1 and an input of NOR gate 1. The clock signal $\phi_c$ is connected to the clock input of the flip-flop 18. The output of the flip-flop 18 is is connected to the other input to the NOR gate 1 and to the other input of NAND gate 1, and the output of the NOR gate 1 is connected to the inverter $In_5$ and to the input of the NAND gate 2. The output of the NAND gate 1 is connected to the set input of the RS type flip-flop $RS_7$ made up of NAND gates, and to the reset input thereof the clock signal $\phi_a$ is applied. The clock signal $\phi_d$ is connected to an input of NAND gate 2. To the NAND gate 3, the signal $\overline{Q}_{19}$ from the divider 19, the set output of flip-flop $RS_7$ and the clock signal $\phi_e$ are imputted. The output of NAND 2 and the output of NAND 3 are inputted to the NAND gate 4. It should be noted that the output CL of NAND gate 4 is the input to the pulse input terminal CP of the up-down counter 15 of FIG. 4, and the output S of flip-flop 16 is another input applied to the U/D terminal of the up-down counter 15 of FIG. 4.

In FIG. 5, a chattering quality of signal $P_2s$ is eliminated by three RS type flip-flops $RS_1$, $RS_2$ and $RS_3$. The chattering quality of signal $P_1s$ is eliminated by three RS type flip-flops $RS_4$, $RS_5$ and $RS_6$. The flip-flops 16 determines which signal $P_1c$ or $P_2c$ arrives first. When the signal $P_1c$ rises first, the output of the flip-flop 16 is at a positive level, and when the signal $P_2c$ rises first the output S is at a negative level. In order to correctly determine the sequence of signal arrival, it is necessary that the anti-chatter circuits output a signal which rises as soon as the input signal begins to change even though the input signal has a chattering quality. When such an anti-chatter circuit uses a precise clock signal to control the response to the input signal, the difference in time between two input signals is extremely small. This causes errors in judging the order of arrival of the two signals. Therefore this method of discrimination is not desirable. OR gate 1 prevents the malfunction due to a delay in the signal fall caused by the anti-chatter circuit. The flip-flop 17 controls the timing of the input signal and the flip-flop 18 generates differential pulses at the times of rise and fall of the signals. When the output Pc of the flip-flop 17 changes from a negative level to a positive level, differential pulses are delivered from the inverter $In_5$ at the instant of rise, and the divider 19 is reset. At the same time a division of the clock signal $\phi_b$ begins in the divider 19 and continues until the output Pc goes to a negative level, whereby a time period when the output Pc is at a positive level is measured. If the output Pc continues to be at a positive level for a long time, the signal $\overline{Q}_{19}$ switches to a negative level and the divider 19 stops its dividing operation by a feedback signal. Accordingly, the signal $\overline{Q}_{19}$ is maintained at a negative level until the output signal Pc changes again from a negative level to a positive level. On the other hand, if the output signal Pc is at a positive level for only a short time, the divider 19 is reset so rapidly that the signal $\overline{Q}_{19}$ cannot change from a positive level to a negative level whereby the signal $\overline{Q}_{19}$ maintains a positive level. Namely, by the level, positive or negative, of the signal $\overline{Q}_{19}$, it can be detected if the time period when the rotary switch changed from OFF to ON is shorter or longer than a prescribed period of time. NAND gate 2 generates a pulse when the switch comes ON or OFF, and NAND gate 3 generates a plurality of pulses when the switch comes ON or OFF in the situation where the time period from ON to OFF is short, that is the rotational speed is fast. At this time, the number of pulses and the timing to generate them are determined by the NAND gate 1, the flip-flop $RS_7$ and the clock signal $\phi_e$.

As stated above, the direction and the rotation of the rotary switch is detected by the circuitry shown in FIG. 5, whereby the count direction, up or down in the up-down counter 15 is controlled. Further, the correcting speed can be changed in response to the rotational speed of the switch. A small change in the circuitry of FIG. 5 can provide a correcting speed which varies in several steps although with the above described switch there are two steps of correcting speed.

This invention is not limited only to a time setting method, but may be widely useful as a means for correcting any value which is digitally displayed, correcting and setting being used interchangeably.

Application of the time keeping techniques discussed provide an improved electronic timepiece which is functionally better and which may be more easily designed for a pleasing appearance and simple mechanical operation by the user.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween

What is claimed is:

1. An electronic timepiece including a plurality of digitally displayed functions comprising:

an oscillator circuit providing a high frequency timing output signal;

a divider network, said divider network dividing down said high frequency signals to produce timekeeping function signals of lower frequency;

display means for visibly presenting said timekeeping functions;

display driver means, said driver means having said timekeeping signals inputted thereto and outputting pulses for driving said display means;

rotary switching means including a plurality of contacts, said contacts closing and opening when said switching means is rotated;

a power source cooperating with said contacts, whereby switch signals indicating the open or closed condition of said contacts are produced;

circuit means sensing said switch signals and adapted to determine, by the sequential order of the closing and opening to said contacts, the rotational direction of said switch means, and to cause one correction in the display of at least one function when said switch means is rotated in one direction and to cause another correction in the display of at least one function when said switch means is rotated in the other direction;

said circuit means correcting said display means by inputting additional pulses to said display driver means, said additional pulses being derived from said divider network.

2. The electronic timepiece of claim 1 wherein said circuit means are further adapted to determine the rate of rotation of said switching means and to correct said display of functions at a rate responsive to said rotational rate of said switching means.

3. The electronic timepiece of claim 2 wherein said rotational rate is determined from the rate of said closings and openings of said switching means contacts.

4. An electronic timepiece including a plurality of digitally displayed functions comprising:

rotary switching means, said switching means including a plurality of contacts, said contacts closing and opening when said switching means is rotated;

a power source cooperating with said contacts whereby switch signals indicating the open or closed condition of said contacts are produced;

circuit means sensing said switch signals and adapted to determine the rotational rate of said switch means, and further adapted to correct the display of at least one function at a rate responsive to the rate of rotation of said switching means, any rotational rate less than a preselected rate causing the same display correction having a first selected magnitude, and a rotational rate greater than said preselected rate causing the same display correction of a second magnitude, said second magnitude of display correction exceeding said first magnitude of display correction.

5. The electronic timepiece of claim 4 wherein said rotational rate is determined by the number of said closings and openings which occur in a fixed period of time.

6. The electronic timepiece of claim 5 and futher comprising:

an oscillator circuit providing a high frequency timing output signal:

a divider network, said divider network dividing down said high frequency signals producing timekeeping functional signals of lower frequency;

display means for visibly presenting said timekeeping functions;

display driver means, said driver means having said timekeeping signals inputted thereto and outputting pulses for driving said display means.

7. Electronic timepiece of claim 1 or 2 wherein said switching means includes a rotary body and a portion of said plurality of contacts rotate with said rotary body and another portion of said plurality of contacts are in fixed positions, said moving contacts making and breaking with said fixed contacts during each revolution of said rotary body.

8. The electronic timepiece of claim 1 or 2 wherein said circuit means include means for detecting the order of arrival of inputted signals, said means for order detecting receiving signals from at least two of said switch contacts upon closing and opening, the earlier arrival of one of said switch signals causing the output of said order detecting means to be in one logic state, the later arrival of said one switch signal causing the output of said order detecting means to be in the opposite logic state;

an up-down counter, the output of said order detecting means being inputted to said up-down counter, said up-down counter counting in one direction for one logic state of said order detecting means output and counting in the other direction when said order detecting means output is opposite;

a decoder, said decoder sensing whether said counter is counting up or counting down, and in response thereto directing the output pulses of said display driver to cause said one correction or said another correction to at least one displayed function.

9. The electronic timepiece of claim 8 wherein said order detecting means includes a flip-flop.

10. The electronic timepiece of claim 1 or 2 and further comprising a counter network receiving a signal from said divider network, said counter network being reset by the closing and opening of said contacts in said rotary switching means, whereby the count in said counter network is responsive to the rotational rate of said rotary switching means, the output of said counter network enabling or disabling the outputting of a plurality of pulses derived from said divider network, said plurality of pulses rapidly correcting said at least one functional display, said counter network output being in the enabling mode when the rotational rate of said switching means excees a prescribed level, said counter network output being in the disabling mode when the rotational rate of said switching means is less than said prescribed level.

11. The electronic timepiece of claim 1 or 2 and further including means for outputting a single corrective pulse to said at least one functional display, said single pulse being outputted for each closing and opening of contacts in said rotary switching means.

12. The electronic timepiece of claim 8 and further comprising a counter network receiving a signal from said divider network, said counter network being reset by the closing and opening of said contacts in said rotary switching means, whereby the count in said counter network is responsive to the rotational rate of said rotary switching means, the output of said counter network enabling or disabling the outputting of a plurality of pulses derived from said divider network, said plurality of pulses rapidly correcting said at least one functional display, said counter network output being in the enabling mode when the rotational rate of said switching means exceeds a prescribed level, said counter network output being in the disabling mode when the rotational rate of said switching means is less than said prescribed level.

13. The electronic timepiece of claim 12 and further including means for outputting a single corrective pulse to said at least one functional display, said single pulse being outputted for each closing and opening of contacts in said rotary switching means.

14. The electronic timepiece of claim 7, wherein said switching means includes a rotary body and a portion of said plurality of contacts rotate with said rotary body and another portion of said plurality of contacts are in fixed positions, said moving contacts making and breaking with said fixed contacts during each revolution of said rotary body.

15. An electronic timepiece including a plurality of digitally displayed functions comprising:

rotary switching means including a plurality of contacts, said contacts closing and opening when said switching means is rotated;

a power source cooperating with said contacts, whereby switch signals indicating the open or closed condition of said contacts are produced;

circuit means sensing said switch signals and adapted to determine the rotational direction of said switch means and to cause one correction in the display of at least one function when said switch means is rotated in one direction and to cause another correction in the display of at least one function when said switch means is rotated in the other direction;

an oscillator circuit providing a high frequency time output signal;

a divider network, said divider network dividing down said high frequency signals to produce timekeeping function signals of lower frequency;

a counter network receiving a signal from said divider network, said counter network being reset by the closing and opening of said contacts in said rotary switching means, whereby the count in said counter network is responsive to the rotational rate of said rotary switching means, the output of said counter network enabling or disabling the outputting of a plurality of pulses derived from said divider network, said plurality of pulses rapidly correcting said at least one functional display, said counter network output being in the enabling mode when the rotational rate of said switching means exceeds a prescribed level, said counter network output being in the disabling mode when the rotational rate of said switching means is less than said prescribed level.

16. An electronic timepiece as claimed in claim 7 and further comprising:

circuit means sensing said switch signals and adapted to determine the rotational direction of said switch means, and to cause one correction in the display of at least one function when said switch means is rotated in one direction and to cause another correction in the display of at least one function when said switch means is rotated in the other direction;

whereby corrections of said different magnitude can advance or retard the display.

17. An electronic timepiece including a plurality of digitally displayed functions comprising:

rotary switching means including a plurality of contacts, said contacts closing and opening when said switching means is rotated;

a power source cooperating with said contacts, whereby switch signals indicating the open or closed condition of said contacts are produced;

circuit means sensing said switch signals and adapted to determine the rotational direction of said switch means, and to cause one correction in the display of at least one function when said switch means is rotated in one direction and to cause another correction in the display of at least one function when said switch means is rotated in the other direction;

said circuit means including means for detecting the order of arrival of inputted signals, said means for order detecting receiving signals from at least two of said switch contacts upon closing and opening, the earlier arrival of one of said switch signals causing the output of said order detecting means to be in one logic state, the later arrival of said one switch signal causing the output of said order detecting means to be in the opposite logic state;

an up-down counter, the output of said order detecting means being inputted to said up-down counter, said up-down counter counting in one direction for one logic state of said order detecting means output and counting in the other direction when said order detecting means output is opposite;

a counter network receiving a signal from said divider network, said counter network being reset by the closing and opening of said contacts in said rotary switching means, whereby the count in said counter network is responsive to the rotational rate of said rotary switching means, the output of said counter network enabling or disabling the outputting of a plurality of pulses derived from said divider network, said plurality of pulses rapidly correcting said at least one functional display, said counter network output being in the enabling mode when the rotational rate of said switching means exceeds a prescribed level, said counter network output being in the disabling mode when the rotational rate of said switching means is less than said prescribed level;

a decoder, said decoder sensing whether said counter is counting up or counting down, and in response thereto directing the output pulses of said display driver to cause said one correction or said another correction to at least one display function.

18. The electronic timepiece as claimed in claim 17, wherein said order detecting means includes a flip-flop.

19. The electronic timepiece as claimed in claim 17 and further including means for outputting a single corrective pulse to said at least one functional display, said single pulse being outputted for each closing and opening of contacts in said rotary switching means.

20. An electronic timepiece including a plurality of digitally displayed functions comprising:

rotary switching means, said switching means including a plurality of contacts, said contacts closing and opening when said switching means is rotated;

a power source cooperating with said contacts whereby switch signals indicating the open or closed condition of said contacts are produced;

circuit means sensing said switch signals and adapted to determine the rotational rate of said switch means, and further adapted to correct the display of at least one function at a rate responsive to the rate of rotation of said switching means, any rotational rate less than a preselected rate causing the same display correction having a first selected magnitude, and a rotational rate greater than said preselected rate causing the same display correction of a second magnitude, said second magnitude of display correction exceeding said first magnitude of display correction, said rotational rate being determined by the number of said closings and openings which occur in a fixed period of time;

an oscillator circuit providing a high frequency timing output signal;

a divider network, said divider network dividing down said high frequency signals producing timekeeping functional signals of lower frequency;

display means for visibly presenting said timekeeping functions;

display driver means, said driver means having said timekeeping signals inputted thereto and outputting pulses for driving said display means, said circuit means corrects said display means by inputting additional pulses to said display driver means, said additional pulses being derived from said divider network.

* * * * *